US006428345B2

(12) United States Patent
Sawayanagi et al.

(10) Patent No.: US 6,428,345 B2
(45) Date of Patent: Aug. 6, 2002

(54) CONNECTOR AND CONNECTING STRUCTURE OF CONNECTOR AND CIRCUIT BODY

(75) Inventors: Masahiro Sawayanagi; Kentaro Nagai, both of Shizuoka-ken; Keiichi Ito, Aichi-ken; Kazuyuki Shiraki, Aichi-ken; Isao Yoneyama, Aichi-ken, all of (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/769,288

(22) Filed: Jan. 26, 2001

(30) Foreign Application Priority Data

Jan. 28, 2000 (JP) ..... 2000-020512

(51) Int. Cl.[7] ..... H01R 13/58; H01R 13/40
(52) U.S. Cl. ..... 439/456; 439/459; 439/596
(58) Field of Search ..... 439/595, 596, 439/496, 456, 459, 465

(56) References Cited

U.S. PATENT DOCUMENTS 5,716,242 A * 2/1998 Myer ..... 439/748
5,860,832 A * 1/1999 Wayt et al. ..... 439/465
6,250,972 B1 * 6/2001 Shinchi et al. ..... 439/752

FOREIGN PATENT DOCUMENTS

JP 06-208873 7/1994

* cited by examiner

*Primary Examiner*—Brian Sircus
*Assistant Examiner*—Chandrika Prasad
(74) *Attorney, Agent, or Firm*—Finnegan, Henderson, Farabow, Garrett & Dunner, L.L.P.

(57) ABSTRACT

A housing includes a housing body and a cover. The housing body defines a terminal accommodation chamber for accommodating a terminal connected to the terminal end of a circuit body. The housing body and the cover include respective bent holding parts holding therebetween the circuit body extending from the terminal, bending the circuit body in a thickness direction thereof when the cover covers the housing body for locking.

10 Claims, 2 Drawing Sheets

CONNECTOR AND CONNECTING STRUCTURE OF CONNECTOR AND CIRCUIT BODY

BACKGROUND OF THE INVENTION

The present invention relates a connector and a connecting structure of the connector and a circuit body for connecting a terminal end of the circuit body, such as a flexible flat cable (FFC) or a flexible printed circuit (FPC), with a mating member.

In general, when electrically joining circuits by a flat circuit body, a connector is mounted to a terminal end of a flat circuit body, and the connector is connected with a mating connector (refer to Japanese Patent Application Laid-Open Publication No. 6-208873).

The flat circuit body has a structure such that conductors are interposed between insulated films. Next, to the terminal end of the circuit body, terminals are crimped and fastened, conducting with respective conductors. Next, the respective terminals are inserted in respective terminal accommodation chambers. Thus, a terminal end structure for connection with the mating connector is completed.

SUMMARY OF THE INVENTION

The terminal end structure of the flat circuit body, however, does not have a structure for protecting crimp-connecting parts of the terminal in a housing. Arrangement operation of a wire harness at assembly causes external force to be applied to the connecting parts, and each contact resistance 3 of the connecting parts can increase.

An object of the present invention is to provide a connector and a connecting structure of the connector and a circuit body which makes external force not to transmit to a connecting part of a terminal and a circuit body, thereby improving reliability of the connecting part.

To achieve the object, a first aspect of the invention provides the following connector. A housing includes a housing body and a cover. The housing body defines a terminal accommodation chamber for accommodating a terminal connected to the terminal end of a circuit body. The housing body and the cover include respective bent holding parts holding therebetween the circuit body extending from the terminal, bending the circuit body in a thickness direction thereof, when the cover covers the housing body for locking.

Preferably, the housing includes a hinge joining the cover integrally to the housing body.

Preferably, the housing body and the cover have respective lock parts provided close to the bent holding parts.

Preferably, the bent holding parts include a recessed part and a protruding part fitted each other, respectively formed at the housing body and the cover, and the recessed part and the protruding part are continuously formed totally transversely across the circuit body.

A second aspect of the invention provides the following connecting structure of a connector and a circuit body. A housing includes a housing body defining a terminal accommodation chamber, and a cover covering the housing body for locking. A circuit body includes a terminal end connected with a terminal. The terminal is inserted in the terminal accommodation chamber. The housing body and the cover include respective bent holding parts holding therebetween the circuit body extending from the terminal, bending the circuit body in a thickness direction thereof.

A third aspect of the invention provides the following connector. A housing accommodates a circuit body connected with a terminal. The housing includes a first part defining an opening for guiding the circuit body. A second part extends from the first part along the circuit body and is uneven with the first part. A cover covers the opening. The cover includes a third part holding the circuit body between the second part and the third part. The third part is uneven with the first part in accordance with the second part.

Preferably, the second part is recessed below the first part along the circuit body.

Preferably, the second part protrudes above the first part along the circuit body.

Preferably, the housing has a first engagement part, and the cover has a second engagement part locking with the first engagement part.

According to the aspects, when external force, or pulling force in particular, is applied to the circuit body drawn out outside the connector, a bent part of the circuit body is subjected to and securely stops the force, so that the force does not transmit to a connecting part of the terminal and the circuit body. As a result, a function of the force does not cause a contact resistance of the connecting part to increase, and a connection reliability is improved.

That is, when the external force is applied to the circuit body, a frictional force is exerted on the circuit body against the external force. In addition, the circuit body is pressed to the bent holding parts, greater frictional force functions to the circuit body.

The connector and the cover are manufactured and handled as one part.

The rock parts or the first and second engagement parts continuously keep high holding force.

BRIEF DESCRIPTION OF THE ACCOMPANYING DRAWINGS

DETAILED DESCRIPTION OF THE PREFERRED EMBODIMENTS

An embodiment of the present invention will be described below based on the drawings.

Figure 1:
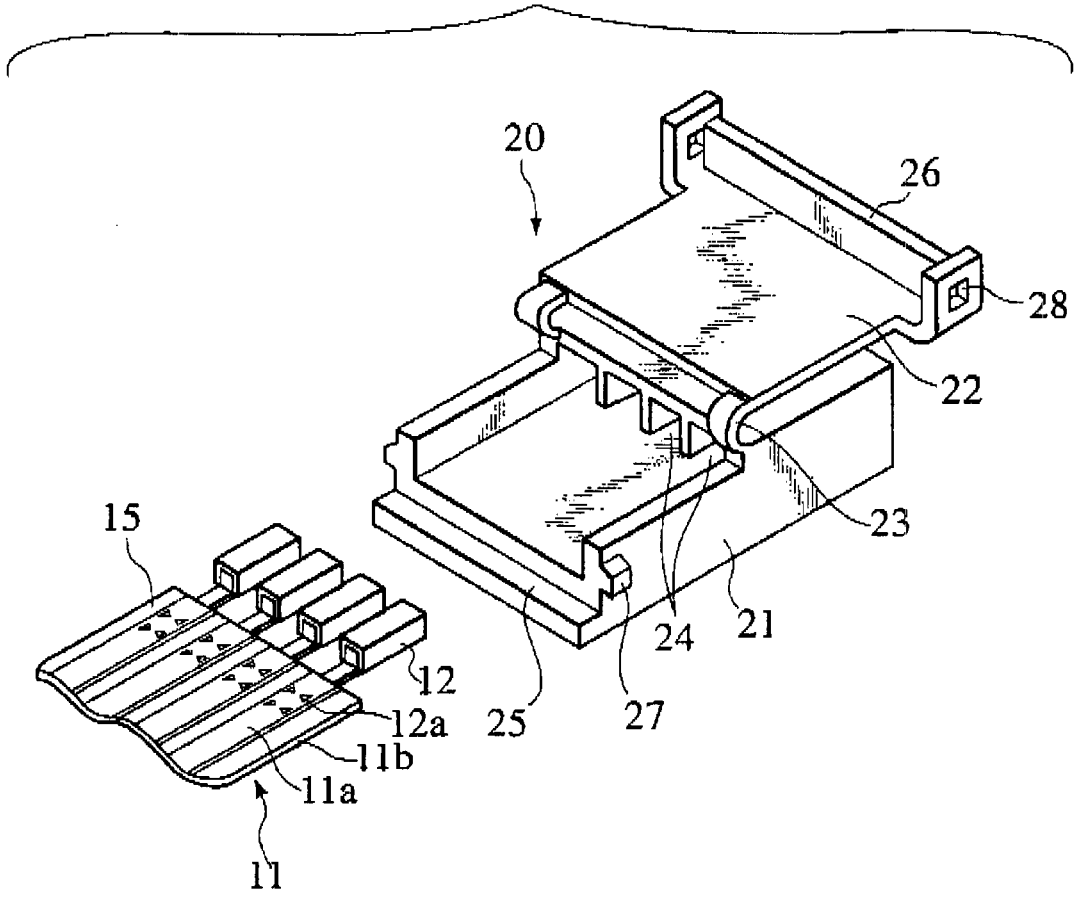
FIG. 1 is a perspective view of a connector and a flat circuit body according to an embodiment of the invention before connection.

The connector is a connector to which a terminal part of a flat circuit body 11 including a plurality of conductors 11*a* buried in parallel inside a flat insulator 11*b* as shown in FIG. 1 is connected. In FIG. 1, positions where the conductors exist are shown with a reference character 11*a*.

The connector is formed of a connector housing 20 and terminals 12. The housing 20 is formed of a body 21 and a cover 22 molded of resin integrally with the body 21 through hinges 23. The body 21 of the housing is substantially in a shape of a rectangular parallelepiped and has a plurality of terminal accommodating chambers 24 extending in a longitudinal direction at a front half part of the body 21. An upper face of a rear half part of the body 21 is open. The open part of the upper face of the rear half part is covered with the cover 22.

The hinges 23 connect a front end of the cover 22 and a rear end of an upper wall of the front half part of the body 21 and hinges 23 in a pair are respectively provided on the left and right. In this case, since the cover 22 and the body 21 are integrated with each other by the hinges 23, the housing 20 can be molded of resin and treated as a part. By rotating the cover 22 about the hinges 23, a necessary part of the body 21 is covered with the cover 22. Flexible bands may be employed for hinges 23.

Engagement parts 27 and 28 for locking the cover 22 and the housing body 21 together in a state in which the body 21 is covered with the cover 22 are provided to left and right opposite side parts of rear ends of the body 21 and the cover 22. To the rear end parts of the housing body 21 and the cover 22, a recessed part 25 and a protruding part 26 as bent holding parts between which the circuit body 11 extending rearward from the terminals 12 accommodated in the terminal accommodating chambers 24 is held while being bent in a thickness direction of the circuit body 11 when the body 21 in covered with and locked to the cover 22 are respectively provided. The recessed part 25 and protruding part 26 have such sectional shapes as to be fitted with each other and are formed continuously throughout widths of the body 21 and the cover 22 to extend across an entire width of the circuit body 11.

To connect the terminal of the circuit body 11 to the connector, the terminals 12 are first secured by crimping to the terminal of the circuit body 11. In other words, since a plurality of lugs 12*a* are formed to project at rear ends of the terminals 12, the lugs 12*a* pierces through and enters into the insulator 11*b* and the conductors 11*a* of the circuit body 11, and the terminals 12 are crimped and secured to the terminal end of the circuit body 11.

Figure 2A:
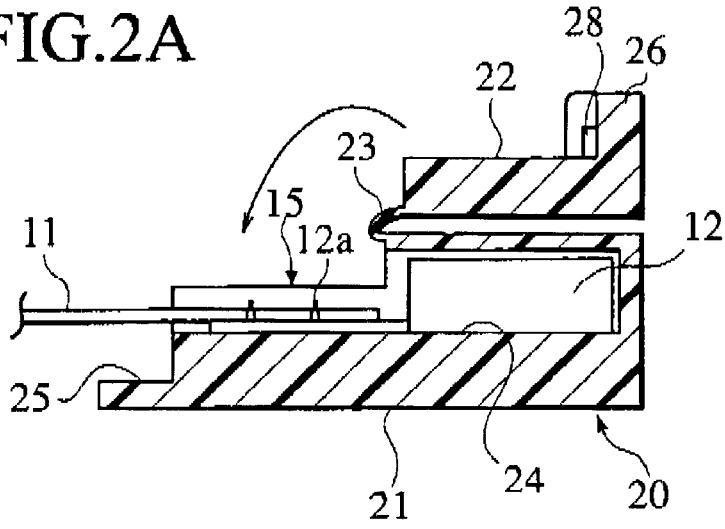
FIG. 2A is a sectional side view showing a state where a terminal mounted to a terminal end of a flat circuit body is inserted in a housing of a connector of an embodiment.

Then, as shown in FIG. 2A, the terminals 12 are inserted into the respective terminal accommodating chambers 24 of the housing 20. As a result, the terminals 12 are locked and prevented from coming off by lances (not shown). In this state, the housing body 21 is covered with the cover 22 from above.

Figure 2B:
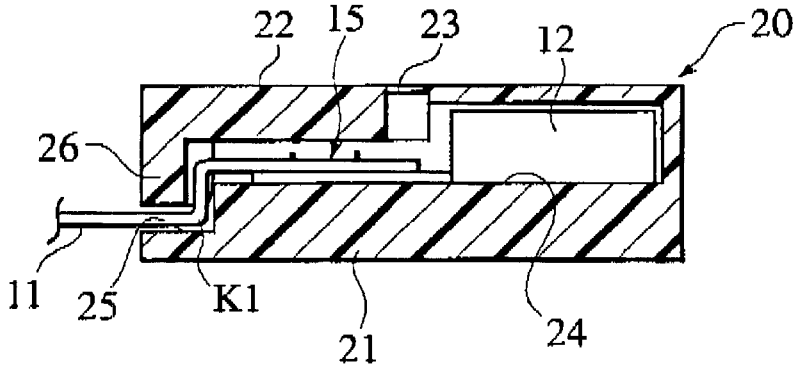
FIG. 2B is a sectional side view showing a state where a cover covers a housing for lock.

Thus, as shown in FIG. 2B, since the recessed part 25 and the protruding part 26 formed on the housing body 21 and the cover 22 are fitted with each other, the circuit body 11 extending rearward from the terminals 12 is held between the recessed part 25 and the protruding part 26 while being bent forcibly.

Therefore, although external force (especially pulling force) is applied to the circuit body 11 drawn out of the housing 20 in this state, the external force can be reliably received by a bent part K of the circuit body 11 and can be prevented from being transmitted to the terminals 12 and connecting parts 15 of the circuit body 11.

At this time, since there are the engagement parts 27 and 28 of the body 21 and the cover 22 in vicinity of the recessed part 25 and the protruding part 26 that are the bent holding parts, high holding force is to be continuously maintained. The entire width of the circuit body 11 which is bent by and held between the recessed part 25 and the protruding part 26 ensures reliability of connection for all the connecting parts 15.

The recessed part 25 and the protruding part 26 as the bent holding parts are not necessarily formed at the rear end of the housing 20 but may be formed in positions on the rear side of the terminals 12 and the connecting parts 15 of the circuit body 11.

Figure 3:
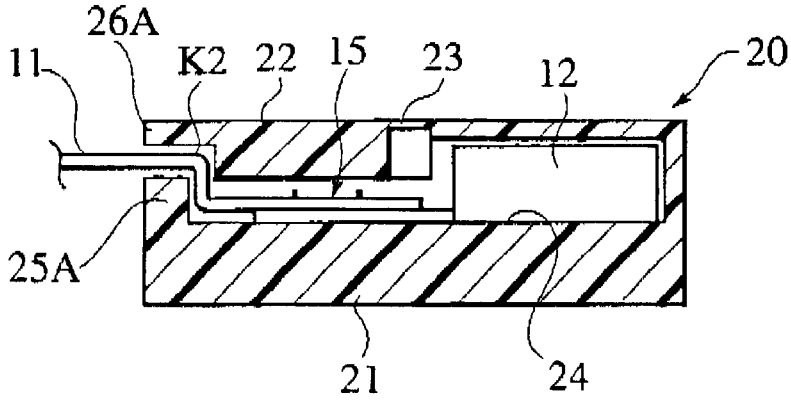
FIG. 3 is a sectional side view of another embodiment.

As shown on FIG. 3, a protruding part 25A may be provided at an end of the housing body 25A. A bent part K2 of the circuit body 11 is held between the protruding part 25A and a recessed part 26A.

While preferred embodiments of the present invention have been described using specific terms, such description is for illustrative purposes, and it is to be understood that changes and variations may be made without departing from the spirit or scope of the following claims.

What is claimed is:

1. A connector comprising:

a housing including a housing body and a cover, the housing body defining a terminal accommodation chamber for accommodating a terminal connected to the terminal end of a circuit body, wherein the housing body and the cover include respective bent holding parts holding therebetween the circuit body extending from the terminal, bending the circuit body in a thickness direction thereof, when the cover covers the housing body for locking.

2. A connector according to claim 1, wherein the housing includes a hinge joining the cover integrally to the housing body.

3. A connector according to claim 1, wherein the housing body and the cover have respective lock parts provided close to the bent holding parts.

4. A connector according to claim 1, wherein the bent holding parts include a recessed part and a protruding part fitted each other, respectively formed at the housing body and the cover, and the recessed part and the protruding part are continuously formed totally transversely across the circuit body.

5. A connecting structure of a connector and a circuit body, comprising:

a housing including a housing body defining a terminal accommodation chamber, and a cover covering the housing body for locking; and a circuit body including a terminal end connected with a terminal, the terminal being inserted in the terminal accommodation chamber, wherein the housing body and the cover include respective bent holding parts holding therebetween the circuit body extending from the terminal, bending the circuit body in a thickness direction thereof.

6. A connector comprising:

a housing accommodating a circuit body connected with a terminal, the housing including a first part defining an opening for guiding the circuit body, and a second part extending from the first part along the circuit body, the second part being uneven with the first part; and a cover covering the opening, the cover including a third part holding the circuit body between the second part and the third part, the third part being uneven with the first part in accordance with the second part.

7. A connector according to claim 6, wherein the second part is recessed below the first part along the circuit body.

8. A connector according to claim 6, wherein the second part protrudes above the first part along the circuit.

9. A connector according to claim 6, wherein the housing has a first engagement part, and the cover has a second engagement part locking with the first engagement part.

10. A connector comprising:

a housing including a housing body and a cover, the housing body defining a terminal accommodation chamber for accommodating a terminal connected to a terminal end of a circuit body, the housing body and the cover including respective bent holding parts for holding the circuit body extending from the terminal therebetween, thereby bending the circuit body in a thickness direction thereof when the cover is in a locked position covering the housing body, wherein the bent holding parts comprise a recessed part formed in one of the housing body and the cover, and a protruding part formed in the other of the housing body and the cover, and wherein the recessed part and the protruding part are formed transversely across the housing.

* * * * *